US005746843A

United States Patent [19]

Miyata et al.

[11] Patent Number: 5,746,843

[45] Date of Patent: May 5, 1998

[54] LOW MN-LOW CR FERRITIC HEAT RESISTANT STEEL EXCELLENT IN STRENGTH AT ELEVATED TEMPERATURES

[75] Inventors: Kaori Miyata; Masaaki Igarashi, both of Osaka; Fujimitsu Masuyama, Nagasaki; Nobuyoshi Komai, Nagasaki; Tomomitsu Yokoyama, Tokyo, all of Japan

[73] Assignees: Sumitomo Metal Industries, Ltd., Osaka; Mitsubishi Jukogyo Kabushiki Kaisha, Tokho, both of Japan

[21] Appl. No.: 799,041

[22] Filed: Feb. 10, 1997

[30] Foreign Application Priority Data

Feb. 10, 1996 [JP] Japan ..... 8-048130

[51] Int. Cl.[6] ..... C22C 38/22; C22C 38/44

[52] U.S. Cl. ..... 148/335; 148/334; 148/328; 148/333; 420/114; 420/106; 420/113

[58] Field of Search ..... 420/113, 114, 420/106; 148/335, 334, 328, 333

[56] References Cited

FOREIGN PATENT DOCUMENTS

| | | |
|---|---|---|
| 0505732 A1 | 9/1992 | European Pat. Off. . |
| 0560375 A2 | 9/1993 | European Pat. Off. . |
| 0560375 A3 | 9/1993 | European Pat. Off. . |
| 57-131349 | 8/1982 | Japan . |
| 57-131350 | 8/1982 | Japan . |
| 61-166916 | 7/1986 | Japan . |
| 62-054062 | 3/1987 | Japan . |
| 63-018038 | 1/1988 | Japan . |
| 63-062848 | 3/1988 | Japan . |
| 1-029853 | 1/1989 | Japan . |
| 1-068451 | 3/1989 | Japan . |
| 2-217438 | 8/1990 | Japan . |
| 2-217439 | 8/1990 | Japan . |
| 3-064428 | 3/1991 | Japan . |
| 3-087332 | 4/1991 | Japan . |
| 4-268040 | 9/1992 | Japan . |

OTHER PUBLICATIONS

"Alloy Steel Boiler and Heat Exchanger Tubes", JIS G 3462 (1988), pp. 1481–1484.

*Primary Examiner*—Deborah Yee

*Attorney, Agent, or Firm*—Burns, Doane, Swecker & Mathis, LLP

[57] ABSTRACT

A low Mn-low Cr ferritic heat resistant steel consisting essentially of, in weight %: 0.02–0.20% C, up to 0.7% Si, less than 0.1% Mn, up to 0.8% Ni, 0.8–3.5% Cr, 0.01–3.0% W, 0.1–0.5% V, 0.01–0.20% Nb, 0.001–0.05% Al, 0.0005–0.05% Mg, 0.0005–0.01% B, less than 0.05% N, up to 0.03% P, up to 0.015% S, 0.001–0.05% Ti and the balance Fe and incidental impurities, wherein the B content is defined so as to satisfy the following formula (14/11)B>N–N(V/51)/{(C/12)+(N/14)}–N(Nb/93)/{(C/12)+(N/14)}–N(Ti/48)/{C/12)+(N/14)}. The steel can further contain optionally 0.01–1.5% Mo, and/or one or more elements selected from the group consisting of 0.01–0.2% La, 0.01–0.2% Ce, 0.01–0.2% Y, 0.01–0.2% Ca, 0.01–0.2% Ta and 0.01–0.2% Zr. The steel can be used in place of the austenitic steels or high Cr ferritic steels, since it has remarkably improved toughness, workability and weldability, and excellent creep properties at elevated temperatures.

19 Claims, 1 Drawing Sheet

LOW MN-LOW CR FERRITIC HEAT RESISTANT STEEL EXCELLENT IN STRENGTH AT ELEVATED TEMPERATURES

FIELD OF THE INVENTION

This invention relates to a low Mn-low Cr ferritic heat resistant steel which is excellent in creep rupture strength at high temperatures over 550° C. and has good hardenability even in thick products. The steel also is excellent in toughness at low temperatures below room temperature, and is suitable for casting or forging products such as heat exchanger tubes, pipes, heat resistant valves and joints for boilers, chemical plants, nuclear plants, etc.

BACKGROUND OF THE INVENTION

In general, austenitic stainless steels, high Cr steels containing 9–12% Cr ("%" means "weight percent" herein), low Cr steels containing up to 3.5% Cr, and carbon steels are used for the heat resistant and pressure resistant materials of boilers, chemical plants, nuclear plants, etc. These steels are selected in consideration of economical requirements, and service conditions such as pressure and temperature.

Among the above mentioned conventional heat resistant steels, the low Cr ferritic steel containing up to 3.5% Cr has advantages in that (1) it is superior to carbon steel in oxidation resistance, corrosion resistance and strength at high temperatures due to Cr; (2) it is much cheaper, has a smaller coefficient of thermal expansion, and is more resistant to stress corrosion cracking in comparison with the austenitic steel; and (3) it has higher toughness, thermal conductivity and weldability in comparison with the high Cr ferritic steel.

The so-called "Cr-Mo steels" such as JIS STBA 20 are known as the typical low Cr ferritic steel. In addition, low Cr ferritic steels comprising one or more precipitation hardening elements, V, Nb, Ti, Ta and B are disclosed in Japanese Patent Kokai No. 57-131349, No. 57-131350, No. 61-166916, No. 62-54062, No. 63-18038, No. 63-62848, No. 64-68451, No. 1-29853, No. 3-64428 and 3-87332.

Furthermore, 1Cr-1Mo-0.25V steel for turbine materials and 2.25Cr-1Mo-Nb steel for fast breeder reactor materials are well known.

However, the known steels cannot be used satisfactorily at elevated temperatures above 550° C., because of poor oxidation resistance, corrosion resistance and high temperature strength in comparison with the austenitic steels.

One of the present applicants disclosed low Cr ferritic steels characterized by containing considerable amounts of W or by combining Cu and Mg in order to improve the creep rupture strength at elevated temperatures above 550° C. (Japanese Patent Kokai No. 2-217438 and No. 2-217439).

The present applicants also disclosed a low Cr ferritic steel in which a small amount of B was added under the condition of lowering N content to improve the creep rupture strength at elevated temperatures above 550° C. and to suppress embrittlement caused by strengthening (Japanese Patent Kokai No. 4-268040).

The reason for strengthening the low Cr ferritic steel is that there are so many advantages as described below:

a) There are some industrial fields where the conventional low Cr ferritic steel cannot be applied because of its low strength at elevated temperatures. The austenitic steel or the high Cr ferritic steel is applied to such fields even if high temperature corrosion is not so severe. The strengthened low Cr ferritic steel can be used in such fields and its advantages such as good weldability can be utilized.

b) Thermal efficiency of the parts which are made of the strengthened steel can be improved, because the parts can be thin and have a large heat conductivity. Additionally, thermal fatigue of the product caused by the repeat of start and stop of plants becomes smaller.

c) It is possible to make plants compact and cheap by making parts of them thin and light.

The conventional low Cr ferritic steels, including the steels disclosed by the applicants, are still not high enough in high temperature strength. For instance, the creep rupture strength after long time aging at high temperatures (particularly over 550° C., 100,000 hours) is not sufficient.

The strength of the conventional low Cr ferritic steels depends on solid solution hardening of Mo and/or W, and precipitation hardening of fine carbides. However, precipitates of Mo and W are not stable at elevated temperatures over 550° C. and become coarse. Intermetallic compounds also become coarse. Accordingly, the creep rupture strength of the conventional low Cr ferritic steels after long time aging at high temperatures is poor.

Although increasing Mo or W content is considered to be effective, these elements easily precipitate at elevated temperatures and lose their solid solution hardening effect. Additionally, large amounts of Mo or W reduce the toughness, workability and weldability of the steel.

Precipitation hardening elements such as V and Nb are effective to strengthen the steel. However, an excessive amount of such precipitates in the ferrite matrix makes the steel hard and reduces the toughness and weldability. Therefore, these elements cannot be added so much.

As mentioned above, the conventional method to strengthen the low Cr ferritic steel does not work sufficiently because of unstable structure, and cannot attain enough high temperature creep strength. Furthermore, the unstable structure deteriorates the toughness and other properties of the steel.

SUMMARY OF THE INVENTION

The purpose of this invention is to provide a low Cr ferritic heat resistant steel which contains not more than 3.5% Cr, and has an improved creep rupture strength under conditions of long periods of time at high temperatures.

Another purpose of this invention is to provide a low Cr ferritic heat resistant steel which has improved toughness, workability and weldability even if it is used for thick products.

The present inventors found out the following facts A) to H) after extensive experimental work on the conditions for stabilizing the structure of the low Cr ferritic steel for long periods of time at elevated temperatures above 550° C.

A) Most of the conventional low Cr ferritic steels are Cr-Mo steels in which Mo is the main alloying element. However, W which has a larger atomic radius and a smaller diffusion coefficient than Mo can be used in larger amounts to increase the solid solution hardening effect. The large amounts of W also serves to make the precipitates stable and to improve the creep strength at elevated temperatures.

B) Fine carbides ($M_{23}C_6$, $M_7C_3$) containing Cr and Fe as the main elements change into coarse carbides ($M_6C$) containing W, Mo and Cr as the main elements in not only the conventional Cr-Mo steel but also in the steel containing a larger amount of W after being kept at elevated temperatures above 550° C. The coarse carbides reduce the creep strength and the toughness of the steel. Furthermore, the solid solution hardening effect of Mo and W will also be reduced because of precipitation of these elements as carbides after the steel is used for long periods of time at elevated temperatures.

C) In contrast to this, the carbides are stable and the creep strength is improved in the steel containing B even after being used at elevated temperatures for long periods. The reason is that B segregates with C so that the fine carbides, $M_{23}C_6$, become stable and hardly change into coarse carbides, $M_6C$, which reduce the high temperature strength. However, B should be added in a sufficient amount in consideration of the balance of solute B, since B tends to combine with N to form BN precipitates.

D) Large amounts of solute B are preferable to stabilize carbides, but too much B increases precipitation of $M_{23}C_6$ carbides and makes the carbides coarse which reduces the short time creep strength and toughness. Therefore, it is preferable to reduce the amount of N and to fix solute N by Ti instead of B. Ti, as well as B, has a strong bonding force with N. However, in the reaction with C, Ti forms TiC or Ti(C,N) which precipitates with TiN as complex precipitates, although B combines with Fe, Cr and W to make $M_{23}(C,B)_6$, in which M means Fe, Cr and W. As mentioned above, the creep strength of the low Cr ferritic steel is controlled by the stability of $M_{23}C_6$, $M_7C_3$ and $M_6C$. Particularly the precipitation of coarse $M_6C$ reduces the creep strength. Ti does not have any influence on the stability of said carbides ($M_{23}C_6$, $M_7C_3$ and $M_6C$), and only has the effect to fix N.

Consequently, the solute B which satisfies the following formula (a) increases the creep strength. The formula (a) shows the balance of the B content and solute N, Ti, V and Nb contents.

$$(14/11)B > N - N(V/51)/\{(C/12) + (N/14)\} - N(Nb/93)/\{(C/12) + (N/14)\} - N(Ti/48)/\{(C/12) + (N/14)\} \quad (a)$$

E) Lowering Mn content serves to improve the creep strength by stabilizing $M_{23}C_6$, and $M_7C_3$, and to reduce precipitation of the coarse $M_6C$. The reasons are that Mn tends to precipitate with Cr and Fe as carbides and that Mn concentrated in carbides promotes coarsening of the carbides and precipitation of W.

F) As mentioned above, both B and Mn dominate stability of carbides at elevated temperatures. Therefore, the creep strength depends on the balance of B content and Mn content. In detail, the creep strength is improved by reducing precipitation of $M_6C$. Reducing Mn and addition of B serve to keep fine carbides stable for long periods of time at elevated temperatures to improve the creep strength.

G) In some cases, lowering the Mn content reduces the hardenability of the steel and makes the toughness and strength lower because of formation and increase of δ-ferrite in the steel, particularly thick steel products in which the cooling rate is low. However, the addition of B and Ti improves the hardenability, and prevents the lowering of the toughness caused by δ-ferrite in a wide temperature range from room temperature to 550° C. or higher. Furthermore, the addition of B and Ti prevents the reduction of toughness caused by coarsening of carbides.

H) In consequence, the steel structure is stabilized for long periods of time at elevated temperatures due to the complex effect of lowering the Mn content and the addition of suitable amounts of B and Ti. Accordingly, the creep properties for long periods of time are remarkably improved without reduction of hardenability and toughness caused by coarsening of carbides.

The present invention is based on the above mentioned discoveries. The low Cr ferritic heat resistant steel according to this invention has the chemical composition described below:

| | | |
|---|---|---|
| 0.02–0.20% C, | up to 0.7% Si, | less than 0.1% Mn, |
| up to 0.8% Ni | 0.8–3.5% Cr, | 0.01–3.0% W, |
| 0.1–0.5% V, | 0.01–0.20% Nb, | 0.001–0.05% Al, |
| 0.0005–0.05% Mg, | 0.0005–0.01% B, | less than 0.05% N, |
| up to 0.03% P, | up to 0.015% S, | 0.001–0.05% Ti, |

and the balance Fe and incidental impurities, wherein the B content is defined so as to satisfy the following formula:

$$(14/11)B > N - N(V/51)/\{(C/12) + (N/14)\} - N(Nb/93)/\{(C/12) + (N/14)\} - N(Ti/48)/\{(C/12) + (N/14)\}. \quad (a)$$

The low Mn-low Cr ferritic heat resistant steel of this invention is characterized by having not only an excellent high temperature strength but also improved hardenability and toughness because of the above mentioned chemical composition.

In order to further improve the creep strength, toughness, workability and weldability, the steel of this invention can additionally contain 0.01–1.5% Mo, and/or at least one element selected from the group consisting of La, Ce, Y, Ca, Ta and Zr in amounts of 0.01–0.2%, respectively.

BRIEF DESCRIPTION OF THE DRAWING

" In FIG. 1, Numbers 2, 3, and 7 to 10 refer to the specimen numbers of the steels of this invention in Table 2. Marks E, G, H, J, K, M, O and P refer to the specimen marks of the steels of the comparative examples in Table 1.

DETAILED DESCRIPTION OF THE INVENTION

Figure 1:
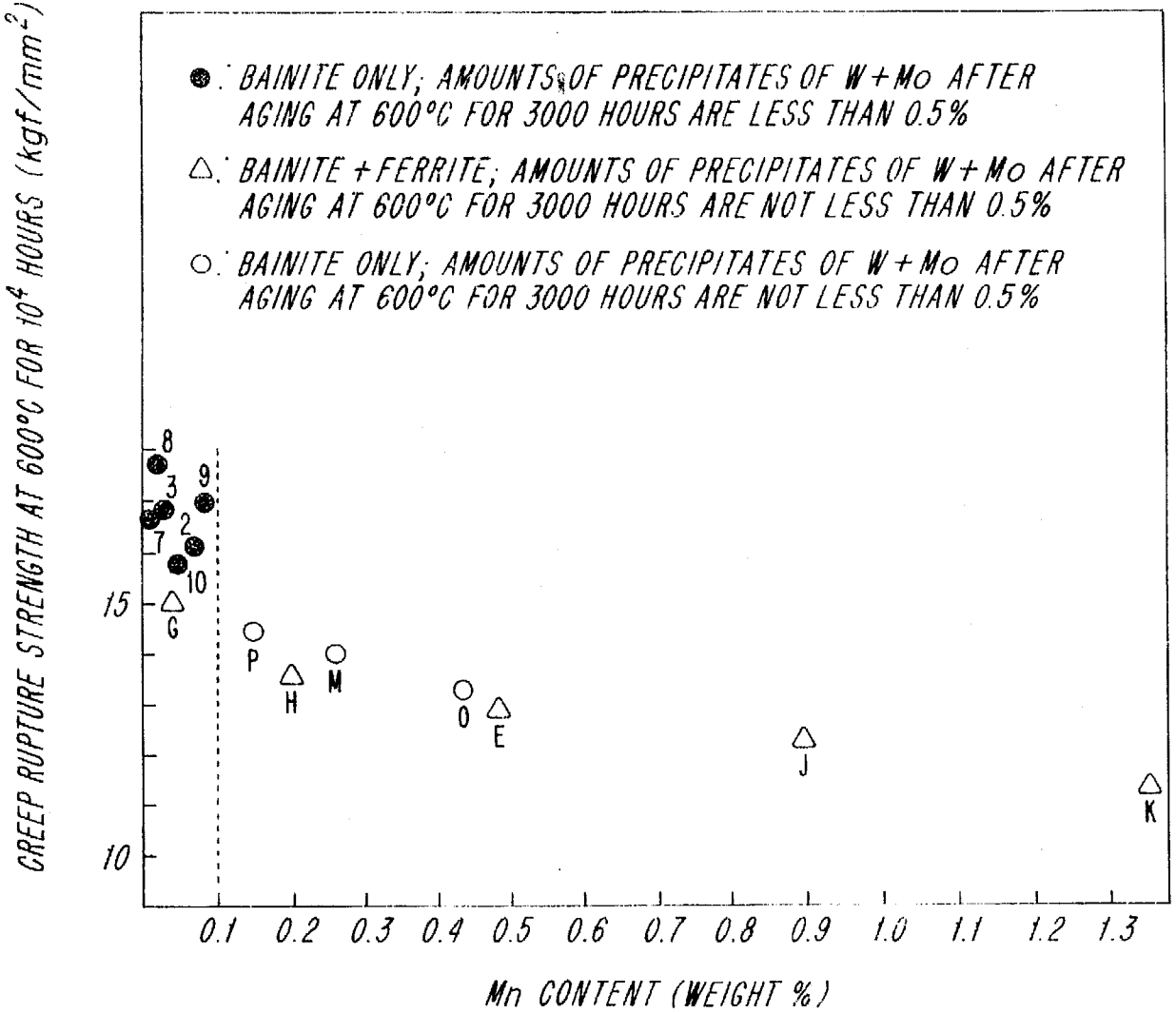
FIG. 1 shows the influence of Mn content on "creep rupture strength at 600° C. for $10^4$ hours" and "amounts of precipitates of W and Mo after aging at 600° C. for 3000 hours.

In the steel of this invention which contains the proper amounts of W, and optionally Mo, the Mn content is lowered and the proper amounts of B and Ti are added in order to stabilize precipitates of V and Nb and fine carbides ($M_{23}C_6$, and $M_7C_3$) containing W and/or Mo as the main components. Consequently, the structure of the steel is kept stable at elevated temperatures for long periods of time, and also reduction of toughness is prevented.

The reasons for defining the content of each alloying element are as follows:

a) C:

C serves to stabilize austenitic structure of the steel, and combines with any alloying elements of Cr, Fe, W, Mo, V and Nb to form carbides thereof, and consequently increase the high temperature strength of the resultant steel. After being subjected to normalizing-tempering heat treatment, the steel of this invention has a structure consisting substantially of bainite or a mixed structure of bainite and small amounts of ferrite, martensite and/or pearlite. C serves to control the balance of these phases.

If the C content is less than 0.02%, precipitation of the carbide is not enough and amounts of δ-ferrite unfavorably increase in the matrix, resulting in lowering of the strength and toughness of the steel. On the other hand, if the C content exceeds 0.20%, excess amounts of the carbides precipitate in the matrix, and the resultant steel becomes too hard to have sufficient weldability and workability. The C content is therefore restricted to a range of 0.02 to 0.20%.

b) Si:

Si serves as a deoxidizing agent in molten steel and increases the resistance of the steel to an attack of oxidizing water vapor. If the Si content exceeds 0.7%, the toughness of the resultant steel is markedly reduced. An excessive amount of Si is also detrimental to the creep rupture strength of the steel. Furthermore, in order to avoid embrittlement of the steel caused by long periods of heating particularly in thick products, the Si content should be suppressed to a lower level. Accordingly, the Si content is restricted to up to 0.7%.

c) Mn:

The steel of this invention is characterized in that the Mn content is suppressed to an especially low level and in that V, Nb and proper amounts of W, Ti and B are added.

Usually Mn is added to deoxidize the molten steel and to improve hot workability of the steel. However, the present inventors found the fact that Mn concentrates into carbides and reduces stability of fine carbides which serve to improve the creep strength. Particularly, if the Mn content is 0.1% or more, the transformation of fine carbides into coarse precipitates containing W, Mo and Fe as the main components ($M_6C$ and intermetallic compounds) is accelerated when the steel is used at elevated temperatures over 550° C. for long periods of time. The coarse precipitates and the precipitation of W and Mo lower the creep strength at elevated temperatures for long periods of time.

FIG. 1 is a graph showing the influence of Mn content on the creep rupture strength at 600° C. for $10^4$ hours, and on amounts of precipitates of W and Mo after aging at 600° C. for 3000 hours. As is apparent from FIG. 1, when the Mn content is lower than 0.1%, the "amounts of precipitates of W and Mo" can be kept less than 0.5%, and the "creep rupture strength at 600° C. for $10^4$ hours" is much higher than that of the steel with Mn content not less than 0.1%.

The suppressing of Mn content is also effective to prevent precipitation of carbides around grain boundaries and coarsening of the carbides caused by addition of B. This is another reason for the improvement of the creep strength at elevated temperatures. Consequently, the Mn content is restricted to less than 0.1%.

Considering the creep rupture strength of the steel, it is desirable to lower Mn content as low as possible. However, lowering Mn content to less than 0.01% results in a very high cost of steel making under the conventional steel making process. Additionally, an extremely low Mn content reduces the hardenability of the steel, and reduces toughness in some cases when the cooling rate is small. As mentioned above, there are no lower limits of Mn content considering the creep rupture strength of the steel but it is considered that the practical target of the lower limit of Mn is 0.01%.

d) Ni:

Ni is one of the austenite stabilizing elements and improves the toughness of the steel. However, more than 0.8% Ni lowers the high temperature creep strength, and a higher content of Ni is not recommended for economical reasons. The Ni content is therefore restricted to a range of up to 0.8%.

e) Cr:

Cr is one of the indispensable elements for maintaining oxidation and corrosion resistance at high temperatures of the steel. If the Cr content is not more than 0.8%, the desired effect of Cr cannot be obtained. On the other hand, if the Cr content exceeds 3.5%, toughness, workability and thermal conductivity of the steel are lowered, and thereby advantages of the low Cr ferritic steel are reduced. The Cr content is therefore restricted in a range of 0.8 to 3.5%.

f) W:

W is effective in increasing the strength of the steel by strengthening the matrix with a solid solution of W therein and by dispersing the precipitates of the fine W carbides in the matrix. These effects of W cannot be obtained when the W content is less than 0.01%. On the other hand, the toughness, workability and weldability decrease when the W content is more than 3.0%. Accordingly, the W content is restricted in a range of 0.01 to 3.0%.

In addition, the combined addition of Mo and W is much more effective in increasing the strength, particularly creep strength, than the sole addition of W or Mo.

g) V:

V combines with the C and N to form fine precipitates of V(C,N), which contribute to increase the creep strength at high temperatures for long periods of applied stress. If the V content is less than 0.1%, these effects cannot be fully obtained. On the other hand, if the V content is higher than 0.5%, too much precipitation of V(C,N) reduces the strength and toughness of the steel. The V content is therefore restricted in a range of 0.1 to 0.5%.

h) Nb:

As with V, Nb combines with the C and N to form fine precipitates of Nb(C,N) which contribute to increase the creep strength of the resultant steel. Particularly, Nb forms fine and stable precipitates which remarkably improve the creep strength at temperatures up to 625° C. The fine precipitate of Nb(C,N) is also effective in improving the toughness of the steel. Less than 0.01% Nb cannot achieve the above-mentioned effects, while more than 0.20% Nb increases NbC in the unsolved or precipitated state, resulting in a reduction of strength, ductility and weldability. Accordingly, the Nb content is restricted in a range of 0.01 to 0.20%.

i) Al:

Al is an essential element as a deoxidizing agent of the steel. If the Al content is lower than 0.001%, the deoxidizing effect cannot be obtained. On the other hand, more than 0.05% Al lowers the creep strength and the toughness. The Al content is therefore restricted in a range of 0.001 to 0.05%.

j) Mg:

A small amount of Mg combines with O (oxygen) and S to improve the toughness and workability of the steel. Mg is also effective to increase creep rupture ductility and strength. These effects are remarkable particularly in the steel containing V and Nb, and considerable amounts of W. If the Mg content is less than 0.0005%, the above mentioned effects cannot be obtained. On the other hand, if the steel contains more than 0.05% of Mg, not only are the effects saturated, but the workability of the steel is worsened. The Mg content is therefore restricted in a range of 0.0005 to 0.05%.

k) Ti:

Ti combines with C and N to form precipitates of Ti(C,N). In particular, Ti is effective to fix solute N, because of the strong bonding force between Ti and N.

As is described later, B also has the effects to fix solute N, but the embodiment to combine with C is quite different from Ti. B tends to segregate in the carbides containing Fe, Cr and W as the main constituents, and excess amounts of B accelerates cohesion and growth of the carbides. On the contrary, Ti combines only with C, and, in some cases, the TiC precipitates with TiN to form complex precipitates. Ti therefore does not accelerate cohesion and growth of the carbides. Accordingly, Ti is a preferable element which effectively fixes N and has no influence on the stability of carbides. Ti improves the hardenability, toughness and creep strength of the steel by reducing solute N as mentioned above. However, if the Ti content is less than 0.001%, the effects cannot be obtained. On the other hand, if the Ti content exceeds 0.05%, too much TiC and Ti(C,N) precipitates and the toughness of the steel is lowered.

l) B:

B is added to the steel in order to obtain the following two effects:

(1) To recover the hardenability of the steel by solute B (B in a form of solid solution). Although the decreased Mn content reduces the hardenability of the steel, the solute B improves the hardenability and suppresses the formation of δ-ferrite, and thereby improves the toughness of the steel.

(2) To stabilize fine carbides ($M_{23}C_6$ carbides) by coprecipitating with C.

As mentioned before, if the low Cr ferritic steel is heated at elevated temperatures for long periods of time, W and/or Mo concentrate in $M_{23}C_6$ carbides and changes them into coarse carbides ($M_6C$). Thus, the creep strength and the toughness of the steel are reduced. B stabilizes the $M_{23}C_6$ carbides and prevents the precipitation of the coarse $M_6C$ carbides, and thereby prevents reduction of the creep strength.

Less than 0.0005% of B cannot achieve the above-mentioned effects. On the other hand, if the B content is more than 0.01%, too much B segregates along grain boundaries, and, in some cases, B precipitating with C makes the carbides $M_{23}C_6$ and $M_7C_3$ coarse. Thus, more than 0.01% B decreases the workability, toughness and weldability of the steel. The B content is therefore limited in a range of 0.0005 to 0.01%.

In order to obtain the above mentioned effects of B, the amounts of solute B should be sufficient. Therefore, it is necessary to balance the B content and amounts of solute N as is defined by the following formula (a):

$$(14/11)B > N - N(V/51)/\{(C/12) + (N/14)\} - N(Nb/93)/\{(C/12) + (N/14)\} - N(Ti/48)/\{(C/12) + (N/14)\}. \quad (a)$$

Since B has a strong bonding force with N, it precipitates as nitrides in the steel containing solute N. Ti, V and Nb also tend to combine with N and C to form carbonitrides such as Ti(C,N), V(C,N) and Nb(C,N). In the heat resistant steel of this invention, the entire N content in the steel must be fixed and sufficient amounts of B should be in the steel in order to obtain the aforementioned improved creep strength, hardenability and toughness. If the steel contains free N (solute N), B precipitates with N and sufficient amounts of solute B cannot be obtained. The formula (a) shows the relationship that the entire N content is fixed in carbonitrides of Ti, V, and Nb, or nitrides of B, and thereby sufficient amounts of solute B can exist in the steel. In the case where formula (a) is not satisfied, solute N combines with B to form nitrides and the amount of solute B is not sufficient.

m) N:

As mentioned above, solute N markedly decreases the ductility and creep strength of the steel. Although N combines with V, Nb, Ti and/or C to form fine carbonitrides and/or carbides which increase the creep strength, excess amounts of N make the carbonitrides coarse and strength, toughness weldability and workability of the steel are decreased. Additionally, excess amounts of N make bainite, martensite and pearlite structures unstable at elevated temperatures. The N content is therefore as low as possible. The upper limit of N is 0.05%, and preferably 0.02%.

n) P and S:

P and S are the inevitable and detrimental impurities which decrease the toughness, workability and weldability of steel. P and S also accelerate the temper embrittlement particularly. P and S therefore should be as low as possible. Upper limits of P and S are 0.03% and 0.015%, respectively.

o) Mo:

Mo, as well as W, improves the creep strength of steel by strengthening the matrix with a solid solution of Mo therein and by dispersing the precipitates of the fine carbide in the matrix. Therefore, Mo can be added optionally. The effects of Mo cannot be obtained with less than 0.01% Mo content. On the other hand, if the Mo content exceeds 1.5%, not only the effects are saturated but also the steel becomes too hard and diminishes toughness, ductility and workability. The Mo content is therefore in a range in 0.01 to 1.5%, when it is added.

p) La, Ce, Y, Ca, Ta and Zr:

These elements can be added optionally in order to control the shapes of inclusions which are formed of these elements and impurities, P, S and O. One or more of them are effective to improve the toughness, strength, workability and weldability of the steel by the above mentioned effects. However, less than 0.01% of each cannot produce these effects on the steel. On the other hand, if the alloy contains more than 0.2% of each element, the toughness and strength are worsened by excessive amounts of inclusions. Accordingly, the content of each of these elements should be in a range of 0.01 to 0.2%. When the steel contains two or more of these elements, the sum of the contents of such elements is preferably not more than 0.2%.

EXAMPLE

Steels having the chemical compositions listed in Tables 1, 2 and 3 were melted in a vacuum melting furnace of 150 kg capacity and cast into ingots. The ingots were forged in a temperature range of 1150° to 950° C. into plates of 20 mm thickness. Marks A and B refer to JIS STBA 22 and STBA 24, respectively. Both are specimens of comparative examples of the typical conventional low Cr ferritic steels.

Marks C and D are comparative examples of 2.25 Cr-1 Mo base precipitation hardening steels containing V and Nb, Marks C to K are comparative examples of steels without Ti, Marks L to P are comparative examples of steels containing various amounts of Mn, Marks Q to S are comparative examples of steels containing B and N in different ratios, and Marks T to Y are comparative examples of steels in which contents of C, Ni, Mo, V, Nb and Ti are outside of the range of this invention. The examples of the steels according to this invention are Marks 1 to 35.

Test specimens A and B were subjected to the heat treatment according to JIS, i.e., heating at 920° C. for 1 hour and air-cooling. Test specimens C to S and 1 to 11 were normalized for 0.5 hour at 1050° C. followed by air cooling, and then tempered for 1 hour at 780° C. followed by air cooling.

After being heat-treated as mentioned above, properties of each test specimen are estimated by room temperature tensile tests, creep rupture tests and Charpy impact tests.

The room temperature tensile tests and the creep rupture tests were carried out by using test specimens of 6 mm diameter and 30 mm gauge length. The creep rupture tests were carried out at 600° C. for 15,000 hours at the longest and the creep rupture strength at 600° C. for $10^4$ hours was estimated by interpolation. This creep rupture test is an accelerated test under a high stress and the results of 600° C. for $10^4$ hours guarantee the creep rupture strength at a temperature higher than 550° C. for periods of time longer than 100,000 hours.

Charpy impact tests were carried out using 10 mm×10 mm×2 mm V-notched test specimens (JIS No. 4 specimens), and ductile-brittle transition temperatures were estimated.

Some of the specimens were subjected to aging treatment at 600° C. for 3,000 hours, thereafter the specimens were dissolved in a non-aqueous solvent by the SPEED method (Selected Potentiostatic Etching by Electrolytic Dissolution Method). The extraction residue was subjected to quantitative analysis to determine contents of W and Mo in the precipitates of the specimens.

Further, in order to estimate the hardenability, ferrite phase was inspected in the specimens subjected to the heat treatment of normalizing at 1050° C. for 0.5 hours and cooled with the cooling rate of 500° C./hour which is faster by 4 times than the conventional air cooling. If the steel does not have enough hardenability, ferrite phase appears after this treatment.

Test results are set forth in Tables 4, 5 and 6. The aforementioned FIG. 1 shows these results arranged in order to make clear the influence of Mn content on "creep rupture strength at 600° C. for $10^4$ hours" and "amounts of precipitates of W and Mo after aging at 600° C. for 3000 hours" in the examples of this invention and comparative examples.

As shown in Tables 4, 5, 6 and FIG. 1, the comparative steels E, F and H to P, which contain not less than 0.1% Mn, have poor creep strength, since large amounts of coarse precipitates consisting mainly of W and Mo were formed after the long term aging.

The steel not containing Ti, such as steel G, has poor hardenability and toughness even if its Mn content is less than 0.1%.

Since the comparative steels Q to S do not satisfy the above mentioned formula (a), i.e., do not contain sufficient amounts of B, the toughness and creep strength of them are rather low because of poor hardenability.

Either toughness or creep properties are not good for the comparative steels which contain C, Ni, Mo, Mg, V, Nb and Ti in amounts outside of the range according to this invention. In these steels, too many inclusions or δ-ferrite were formed.

The steels of this invention, as shown in Tables 5 and 6, have good ductility of more than 25% elongation. Additionally, the ductile-brittle transition temperatures in Charpy tests of the steels of this invention are lower than −25° C., showing excellent toughness.

The high temperature strengths of the steels are remarkably improved, i.e., all of them have more than 15.5 kgf/$mm^2$ creep rupture strength at 600° C. for $10^4$ hours. The reasons for such improved creep properties are that the structures are stable and the precipitation of W and Mo is suppressed for long periods of time at elevated temperatures by reducing the Mn content, the addition of proper amounts of Ti and keeping the solute B in the desirable range.

As described above, according to this invention a low Cr-low Mn ferritic steel having remarkably improved creep rupture strength, toughness, ductility, weldability and hardenability even in the form of heavy and thick products is provided. The steel of this invention can be used in place of not only the conventional low Cr ferritic steel but also can be applied to the field where the high Cr ferritic steels or the austenitic steels are applied.

Since the steel of this invention can be produced at almost the same cost as conventional low Cr ferritic steel, the inventive steel provides significant economical advantages.

Although this invention has been shown and described with respect to a preferred embodiment thereof it should be understood by those skilled in the art that various changes and modifications in the details thereof may be made therein and thereto without departing from the spirit and scope of the invention.

TABLE 1

| Steel | Chemical Composition (weight %, bal.: Fe and Incidental Impurities) | | | | | | | | | |
|---|---|---|---|---|---|---|---|---|---|---|
| No. | C | Si | Mn | P | S | Ni | Cr | Mo | W | V |
| Comparative Example | | | | | | | | | | |
| A | 0.12 | 0.37 | *0.46 | 0.017 | 0.005 | 0.01 | 1.01 | 0.53 | *— | *— |
| B | 0.11 | 0.38 | *0.56 | 0.015 | 0.003 | 0.01 | 2.13 | 1.01 | *— | *— |
| C | 0.13 | 0.17 | *0.48 | 0.012 | 0.004 | 0.13 | 2.20 | 0.98 | *— | 0.23 |
| D | 0.11 | 0.33 | *0.55 | 0.026 | 0;002 | 0.21 | 2.17 | 0.96 | *— | 0.21 |
| E | 0.11 | 0.23 | *0.48 | 0.008 | 0.001 | 0.09 | 3.32 | 0.15 | 2.41 | 0.35 |
| F | 0.08 | 0.56 | *0.48 | 0.005 | 0.011 | 0.08 | 2.56 | 0.99 | 1.71 | 0.17 |
| G | 0.08 | 0.17 | 0.04 | 0.014 | 0.002 | 0.27 | 2.21 | 0.12 | 1.53 | 0.22 |
| H | 0.05 | 0.19 | *0.26 | 0.013 | 0.003 | 0.29 | 2.24 | 0.07 | 1.47 | 0.21 |
| I | 0.06 | 0.20 | *0.53 | 0.911 | 0.003 | 0.28 | 2.23 | 0.09 | 1.56 | 0.26 |
| J | 0.06 | 0.20 | *0.90 | 0.012 | 0.002 | 0.27 | 2.22 | 0.11 | 1.63 | 0.28 |
| K | 0.07 | 0.18 | *1.37 | 0.015 | 0.004 | 0.31 | 2.19 | 0.11 | 1.52 | 0.23 |
| L | 0.06 | 0.25 | *0.65 | 0.009 | 0.004 | 0.30 | 2.25 | — | 1.55 | 0.26 |
| M | 0.08 | 0.20 | *0.26 | 0.013 | 0.003 | 0.28 | 2.31 | 0.11 | 1.48 | 0.21 |
| N | 0.13 | 0.21 | *1.25 | 0.008 | 0.003 | 0.31 | 2.28 | 0.12 | 1.54 | 0.25 |
| O | 0.05 | 0.23 | *0.43 | 0.012 | 0.002 | 0.29 | 2.24 | — | 1.73 | 0.24 |
| P | 0.09 | 0.18 | *0.15 | 0.012 | 0.004 | 0.32 | 2.18 | 0.15 | 1.45 | 0.26 |
| Q | 0.18 | 0.22 | *0.18 | 0.015 | 0.003 | 0.28 | 2.26 | 0.12 | 1.53 | 0.25 |
| R | 0.14 | 0.26 | 0.07 | 0.014 | 0.003 | 0.20 | 2.21 | 0.12 | 1.35 | 0.15 |

TABLE 1-continued

| | | | | | | | | | | |
|---|---|---|---|---|---|---|---|---|---|---|
| S | 0.13 | 0.25 | *0.11 | 0.014 | 0.002 | 0.27 | 2.25 | 0.15 | 1.54 | 0.23 |
| T | *0.30 | 0.18 | *0.13 | 0.015 | 0.003 | 0.25 | 2.19 | 0.11 | 1.44 | 0.25 |
| U | 0.06 | 0.21 | 0.05 | 0.013 | 0.004 | *1.50 | 2.26 | 1.13 | 2.87 | 0.24 |
| V | 0.06 | 0.19 | 0.09 | 0.011 | 0.005 | 0.35 | 2.24 | *2.51 | 2.56 | 0.35 |
| W | 0.18 | 0.01 | 0.05 | 0.012 | 0.005 | 0.29 | 2.23 | 0.11 | 1.63 | 0.25 |
| X | 0.17 | 0.18 | 0.01 | 0.015 | 0.001 | 0.31 | 2.25 | 0.12 | 1.51 | *0.85 |
| Y | 0.06 | 0.20 | 0.06 | 0.009 | 0.003 | 0.25 | 2.23 | 0.35 | 1.62 | 0.20 |

| Steel | Chemical Composition (weight %, bal.: Fe and Incidental Impurities) | | | | | | Values of Formula (a) | |
|---|---|---|---|---|---|---|---|---|
| No. | Nb | Ti | Al | B | N | Mg | Left Side | Right Side |
| Comparative Example | | | | | | | | |
| A | *— | *— | 0.009 | *— | 0.0139 | *— | *0 | *0.0139 |
| B | *— | *— | 0.008 | *— | 0.0158 | *— | *0 | *0.0158 |
| C | 0.05 | *— | 0.015 | *— | 0.0078 | *— | *0 | *0.0043436 |
| D | 0.06 | *— | 0.007 | *— | 0.0165 | *— | *0 | *0.0089036 |
| E | 0.04 | *— | 0.017 | 0.0024 | 0.0018 | *— | 20.0030545 | 0.0003878 |
| F | 0.08 | *— | 0.037 | 0.0036 | 0.0078 | 0.002 | 0.0045818 | 0.003272 |
| G | 0.03 | *— | 0.022 | 0.0049 | 0.0087 | 0.005 | 0.0062364 | 0.0031655 |
| H | 0.06 | *— | 0.018 | 0.0056 | 0.0089 | 0.003 | 0.0071273 | 0.0000733 |
| I | 0.04 | *— | 0.017 | 0.0051 | 0.0078 | 0.003 | 0.0064909 | 0.0000407 |
| J | 0.04 | *— | 0.016 | 0.0061 | 0.0093 | 0.005 | 0.0077636 | −0.00042 |
| K | 0.05 | *— | 0.021 | .0.0048 | 0.0085 | 0.002 | 0.0061091 | 0.0018385 |
| L | 0.05 | 0.018 | 0.008 | 0.0022 | 0.0077 | 0.005 | 0.0028 | −0.000119 |
| M | 0.04 | 0.017 | 0.015 | 0.0037 | 0.0068 | 0.004 | 0.0047091 | 0.0024763 |
| N | 0.05 | 0.040 | 0.016 | 0.0041 | 0.0071 | 0.005 | 0.0052182 | 0.0036944 |
| O | 0.04 | 0.038 | 0.017 | 0.0042 | 0.0083 | 0.004 | 0.0053455 | −0.000657 |
| P | 0.06 | 0.025 | 0.014 | 0.0050 | 0.0101 | 0.005 | 0.0063636 | 0.0030445 |
| Q | 0.04 | 0.015 | 0.017 | 0.0022 | 0.0190 | 0.005 | 0.0028 | *0.0128064 |
| R | 0.02 | 0.021 | 0.013 | *0.0180 | *0.0500 | 0.002 | 0.0229091 | *0.0396436 |
| S | 0.05 | 0.035 | 0.014 | *— | 0.0082 | 0.005 | 0 | *0.0045754 |
| T | 0.07 | 0.013 | 0.015 | 0.0081 | 0.0086 | 0.002 | 0.0103091 | 0.0067015 |
| U | 0.09 | 0.023 | 0.007 | 0.0071 | 0.0180 | 0.005 | 0.0090364 | 0.0017528 |
| V | 0.17 | 0.019 | 0.003 | 0.0050 | 0.0121 | 0.006 | 0.0063636 | −0.005832 |
| W | 0.10 | *— | 0.015 | 0.0052 | 0.0064 | *— | 0.0066182 | 0.0039251 |
| X | *0.35 | *— | 0.008 | 0.0095 | 0.0150 | 0.007 | 0.0120909 | −0.00511 |
| Y | 0.08 | *0.075 | 0.015 | 0.0085 | 0.0081 | 0.007 | 0.0108182 | 0.0011596 |

Note: Mark "*" indicates the value outside of the range according to the present invention.

TABLE 2

| Steel | Chemical Composition (weight %, bal.: Fe and Incidental Impurities) | | | | | | | | | |
|---|---|---|---|---|---|---|---|---|---|---|
| No. | C | Si | Mn | P | S | Ni | Cr | Mo | W | V |
| Example of the Present Invention | | | | | | | | | | |
| 1 | 0.058 | 0.18 | 0.05 | 0.014 | 0.002 | 0.31 | 2.23 | — | 1.62 | 0.25 |
| 2 | 0.065 | 0.19 | 0.07 | 0.013 | 0.003 | 0.30 | 2.25 | — | 1.65 | 0.22 |
| 3 | 0.058 | 0.20 | 0.02 | 0.012 | 0.003 | 0.27 | 2.22 | 0.12 | 1.66 | 0.25 |
| 4 | 0.061 | 0.20 | 0.04 | 0.012 | 0.002 | 0.26 | 2.21 | 0.10 | 1.62 | 0.27 |
| 5 | 0.062 | 0.19 | 0.07 | 0.013 | 0.004 | 9.27 | 2.23 | 0.09 | 1.62 | 0.24 |
| 6 | 0.058 | 0.21 | 0.09 | 0.012 | 0.002 | 0.32 | 2.26 | 0.12 | 1.65 | 0.23 |
| 7 | 0.059 | 0.19 | 0.01 | 0.023 | 0.002 | 0.31 | 1.03 | — | 1.65 | 0.14 |
| 8 | 0.113 | 0.21 | 0.02 | 0.010 | 0.003 | 0.76 | 1.07 | — | 1.95 | 0.21 |
| 9 | 0.130 | 0.20 | 0.09 | 0.006 | 0.002 | 0.12 | 3.48 | — | 2.61 | 0.28 |
| 10 | 0.045 | 0.03 | 0.05 | 0.015 | 0.008 | 0.1 | 2.44 | — | 0.98 | 0.15 |
| 11 | 0.140 | 0.16 | 0.08 | 0.012 | 0.004 | 0.23 | 2.25 | — | 2.03 | 0.26 |
| 12 | 0.090 | 0.55 | 0.01 | 0.005 | 0.011 | 0.08 | 2.26 | 0.99 | 1.72 | 0.15 |
| 13 | 0.088 | 0.41 | 0.02 | 0.012 | 0.002 | 0.03 | 2.54 | 1.12 | 1.71 | 0.24 |
| 14 | 0.081 | 0.53 | 0.02 | 0.005 | 0.011 | 0.08 | 2.53 | 0.98 | 1.71 | 0.18 |
| 15 | 0.056 | 0.08 | 0.04 | 0.007 | 0.002 | 0.02 | 2.36 | 0.87 | 1.69 | 0.20 |
| 16 | 0.081 | 0.19 | 0.09 | 0.008 | 0.002 | 0.03 | 2.42 | 0.86 | 1.69 | 0.22 |
| 17 | 0.062 | 0.28 | 0.05 | 0.012 | 0.005 | 0.04 | 2.35 | 1.01 | 1.75 | 0.15 |
| 18 | 0.070 | 0.18 | 0.05 | 0.005 | 0.008 | 0.07 | 2.28 | 0.31 | 1.71 | 0.18 |
| 19 | 0.050 | 0.08 | 0.06 | 0.019 | 0.009 | 0.06 | 2.25 | 0.33 | 1.65 | 0.21 |
| 20 | 0.062 | 0.19 | 0.02 | 0.012 | 0.003 | 0.25 | 2.22 | — | 1.71 | 0.25 |

TABLE 2-continued

| Steel | Chemical Composition (weight %, Bal.: Fe and Incidental Impurities) | | | | | | | Values of Formula (a) | |
|---|---|---|---|---|---|---|---|---|---|
| No. | Nb | Ti | Al | B | N | Mg | Others | Left Side | Right Side |
| Example of the Present Invention | | | | | | | | | |
| 1 | 0.04 | 0.021 | 0.019 | 0.0028 | 0.0107 | 0.002 | — | 0.0035636 | −0.000329 |
| 2 | 0.03 | 0.042 | 0.028 | 0.0052 | 0.0120 | 0.005 | — | 0.0066182 | 0.0014585 |
| 3 | 0.04 | 0.022 | 0.021 | 0.0021 | 0.0088 | 0.005 | — | 0.0026727 | −0.000529 |
| 4 | 0.05 | 0.015 | 0.019 | 0.0036 | 0.0034 | 0.006 | — | 0.0045818 | −0.000522 |
| 5 | 0.05 | 0.045 | 0.025 | 0.0042 | 0.0305 | 0.002 | — | 0.0053455 | 0.0048343 |
| 6 | 0.04 | 0.032 | 0.022 | 0.0057 | 0.0101 | 0.003 | — | 0.0072545 | −0.000094 |
| 7 | 0.03 | 0.036 | 0.003 | 0.0021 | 0.0075 | 0.002 | — | 0.0026727 | 0.0022486 |
| 8 | 0.09 | 0.031 | 0.012 | 0.0040 | 0.0028 | 0.013 | — | 0.0050909 | 0.0011313 |
| 9 | 0.03 | 0.020 | 0.004 | 0.0069 | 0.0027 | 0.002 | — | 0.0087818 | 0.001746 |
| 10 | 0.04 | 0.032 | 0.040 | 0.0023 | 0.0022 | 0.002 | — | 0.0029273 | −0.000074 |
| 11 | 0.05 | 0.045 | 0.026 | 0.0079 | 0.0120 | 0.003 | — | 0.0100545 | 0.0057017 |
| 12 | 0.07 | 0.028 | 0.035 | 0.0035 | 0.0078 | 0.003 | — | 0.0044545 | 0.0036593 |
| 13 | 0.04 | 0.029 | 0.025 | 0.0029 | 0.0115 | 0.003 | Zr:0.01 | 0.0036909 | 0.0034051 |
| 14 | 0.06 | 0.031 | 0.036 | 0.0076 | 0.0078 | 0.001 | La:0.02 | 0.0096727 | 0.0026545 |
| 15 | 0.05 | 0.028 | 0.008 | 0.0055 | 0.0102 | 0.001 | Ce:0.02 | 0.007 | 0.0006668 |
| 16 | 0.06 | 0.031 | 0.009 | 0.0049 | 0.0095 | 0.002 | Ca:0.02 | 0.0062364 | 0.0023324 |
| 17 | 0.06 | 0.032 | 0.008 | 0.0064 | 0.0115 | 0.002 | Y:0.02 | 0.0081455 | 0.0033322 |
| 18 | 0.05 | 0.018 | 0.006 | 0.0025 | 0.0038 | 0.005 | Ta:0.02 | 0.0031818 | 0.001035 |
| 19 | 0.04 | 0.011 | 0.009 | 0.0039 | 0.0121 | 0.002 | Y:0.02,Ta:0.02 | 0.0049636 | 0.000611 |
| 20 | 0.06 | 0.012 | 0.013 | 0.0057 | 0.0077 | 0.003 | Zr:0.01,Ca:0.02 | 0.0072545 | −0.000108 |

TABLE 3

| Steel | Chemical Composition (weight %, bal.: Fe and Incidental Impurities) | | | | | | | | | |
|---|---|---|---|---|---|---|---|---|---|---|
| No. | C | Si | Mn | P | S | Ni | Cr | Mo | W | V |
| Example of the Present Invention | | | | | | | | | | |
| 21 | 0.071 | 0.54 | 0.01 | 0.015 | 0.003 | 0.04 | 2.54 | 0.28 | 1.68 | 0.18 |
| 22 | 0.075 | 0.09 | 0.01 | 0.015 | 0.003 | 0.29 | 2.24 | — | 1.69 | 0.23 |
| 23 | 0.072 | 0.18 | 0.03 | 0.015 | 0.005 | 0.31 | 2.27 | — | 1.67 | 0.19 |
| 24 | 0.066 | 0.07 | 0.04 | 0.013 | 0.002 | 0.27 | 2.19 | 0.13 | 1.61 | 0.22 |
| 25 | 0.054 | 0.18 | 0.07 | 0.013 | 0.004 | 0.27 | 2.23 | 0.09 | 1.62 | 0.24 |
| 26 | 0.052 | 0.20 | 0.02 | 0.011 | 0.002 | 0.25 | 2.31 | 0.14 | 1.68 | 0.19 |
| 27 | 0.063 | 0.19 | 0.05 | 0.013 | 0.005 | 0.33 | 2.28 | 0.13 | 1.54 | 0.21 |
| 28 | 0.071 | 0.20 | 0.04 | 0.013 | 0.002 | 0.31 | 2.29 | 0.12 | 1.73 | 0.22 |
| 29 | 0.140 | 0.15 | 0.07 | 0.011 | 0.002 | 0.22 | 2.28 | 1.01 | 2.01 | 0.25 |
| 30 | 0.062 | 0.18 | 0.03 | 0.012 | 0.002 | 0.32 | 2.26 | 0.65 | 1.59 | 0.26 |
| 31 | 0.060 | 0.18 | 0.07 | 0.013 | 0.004 | 0.27 | 2.23 | 0.25 | 1.62 | 0.24 |
| 32 | 0.030 | 0.15 | 0.02 | 0.012 | 0.002 | 0.15 | 0.98 | 1.05 | 1.01 | 0.23 |
| 33 | 0.150 | 0.16 | 0.02 | 0.005 | 0.002 | 0.11 | 2.24 | 0.13 | 1.71 | 0.40 |
| 34 | 0.050 | 0.60 | 0.01 | 0.015 | 0.010 | 0.12 | 2.37 | — | 1.63 | 0.25 |
| 35 | 0.090 | 0.02 | 0.02 | 0.013 | 0.002 | 0.13 | 2.51 | — | 1.32 | 0.12 |

| Steel | Chemical Composition (weight %, Bal.: Fe and Incidental Impurities) | | | | | | | Values of Formula (a) | |
|---|---|---|---|---|---|---|---|---|---|
| No. | Nb | Ti | Al | B | N | Mg | Others | Left Side | Right Side |
| Example of the Present Invention | | | | | | | | | |
| 21 | 0.07 | 0.042 | 0.003 | 0.0038 | 0.0152 | 0.002 | La:0.02,Ca:0.01, Ce: 0.02,Y:0.02, Ta:0.02 | 0.0048364 | 0.0040055 |
| 22 | 0.04 | 0.030 | 0.028 | 0.0055 | 0.0093 | 0.005 | La:0.01,Ca:0.01, Ce:0.01 | 0.007 | 0.001815 |
| 23 | 0.04 | 0.025 | 0.019 | 0.0048 | 0.0089 | 0.003 | La:0.02,Ca:0.04, Ce:0.02,Y:0.02, Ta:0.02 | 0.0061091 | 0.0026278 |
| 24 | 0.06 | 0.015 | 0.021 | 0.0050 | 0.0086 | 0.002 | La:0.04,Y:0.02, Ta:0.02 | 0.0063636 | 0.0011856 |
| 25 | 0.05 | 0.012 | 0.025 | 0.0080 | 0.0105 | 0.002 | La:0.04,Ca:0.04, Ce:0.02,Y:0.02, Ta:0.01 | 0.0101818 | −0.000487 |
| 26 | 0.05 | 0.033 | 0.017 | 0.0018 | 0.0120 | 0.015 | — | 0.0022909 | 0.0005545 |
| 27 | 0.05 | 0.015 | 0.019 | 0.0061 | 0.0150 | 0.001 | La:0.01,Zr:0.02, Y:0.01 | 0.0077636 | 0.003212 |

TABLE 3-continued

| | | | | | | | | | |
|---|---|---|---|---|---|---|---|---|---|
| 28 | 0.05 | 0.011 | 0.021 | 0.0032 | 0.0101 | 0.006 | — | 0.0040727 | 0.0023699 |
| 29 | 0.05 | 0.025 | 0.026 | 0.0079 | 0.0110 | 0.005 | — | 0.0100545 | 0.0057348 |
| 30 | 0.05 | 0.024 | 0.019 | 0.0053 | 0.0101 | 0.020 | — | 0.0067455 | −0.000425 |
| 31 | 0.05 | 0.018 | 0.025 | 0.0060 | 0.0105 | 0.001 | — | 0.0076864 | 0.0002401 |
| 32 | 0.02 | 0.011 | 0.020 | 0.0035 | 0.0041 | 0.002 | Ca:0.01,Y:0.01 | 0.0044545 | −0.008173 |
| 33 | 0.02 | 0.032 | 0.612 | 0.0070 | 0.0150 | 0.007 | — | 0.0089091 | 0.0053567 |
| 34 | 0.05 | 0.025 | 0.025 | 0.0075 | 0.0065 | 0.030 | — | 0.0095455 | −0.001866 |
| 35 | 0.17 | 0.020 | 0.017 | 0.0050 | 0.0093 | 0.002 | Ta:0.01,Zr:0.01 | 0.0063636 | 0.0040629 |

TABLE 4

| | Room Temperature Tensile Test | | | Ductile-Brittle | 600° C. $10^4$ hours | Amounts of W + Mo Precipitates after | |
|---|---|---|---|---|---|---|---|
| Steel No. | Tensile Strength (kgf/mm$^2$) | 0.2% Proof Strength (kgf/mm$^2$) | Elongation (%) | Transition Temp. in Charpy Impact Test (°C.) | Creep Rupture Strength (kgf/mm$^2$) | 600° C. 3000 hours Aging (weight %) | Hardenability |
| Comparative Example | | | | | | | |
| A | 50.7 | 30.3 | 39.0 | −39 | 5.3 | — | Δ |
| B | 57.2 | 40.1 | 28.0 | −31 | 6.5 | — | Δ |
| C | 73.2 | 61.3 | 22.5 | 9 | 8.3 | — | Δ |
| D | 69.7 | 58.1 | 19.6 | 0 | 9.4 | — | Δ |
| E | 67.5 | 53.2 | 27.1 | −23 | 12.9 | 0.54 | Δ |
| F | 67.8 | 55.2 | 27.8 | −10 | 13.2 | 0.6 | Δ |
| G | 65.2 | 52.5 | 29.2 | 0 | 15.0 | 0.51 | Δ |
| H | 66.9 | 55.1 | 28.3 | −12 | 13.5 | 0.52 | Δ |
| I | 63.2 | 51.5 | 30.3 | −20 | 12.7 | 0.53 | Δ |
| J | 64.7 | 52.3 | 27.8 | −10 | 12.3 | 0.57 | Δ |
| K | 66.1 | 54.7 | 26.8 | −27 | 11.2 | 0.55 | Δ |
| L | 67.7 | 57.3 | 27.1 | −23 | 12.4 | 0.55 | ⊙ |
| M | 71.4 | 60.4 | 25.8 | −18 | 14.0 | 0.61 | ⊙ |
| N | 68.2 | 57.4 | 26.8 | −11 | 11.5 | 0.54 | ⊙ |
| O | 66.8 | 56.4 | 27.4 | −24 | 13.3 | 0.55 | ⊙ |
| P | 65.9 | 56.1 | 28.1 | −17 | 14.5 | 0.53 | ⊙ |
| Q | 65.9 | 53.8 | 31.5 | −20 | 11.9 | — | Δ |
| R | 63.3 | 54.7 | 28.0 | −19 | 11.8 | — | Δ |
| S | 67.1 | 53.0 | 28.8 | −11 | 12.1 | — | Δ |
| T | 73.1 | 60.3 | 21.9 | 0 | 12.2 | — | ⊙ |
| U | 69.5 | 57.8 | 23.8 | −23 | 11.9 | — | Δ |
| V | 68.1 | 55.7 | 30.1 | 0 | 13.3 | — | ⊙ |
| W | 66.8 | 54.2 | 29.1 | −15 | 15.1 | — | Δ |
| X | 72.8 | 61.3 | 25.0 | 8 | 13.7 | — | Δ |
| Y | 71.4 | 60.8 | 23.1 | 10 | 12.8 | — | ⊙ |

Note: In the column of Hardenability,
⊙: Bainite only (good hardenability)
Δ: Bainite + Ferrite (insufficient Hardenability)

TABLE 5

| | Room Temperature Tensile Test | | | Ductile-Brittle | 600° C. $10^4$ hours | Amounts of W + Mo Precipitates after | |
|---|---|---|---|---|---|---|---|
| Steel No. | Tensile Strength (kgf/mm$^2$) | 0.2% Proof Strength (kgf/mm$^2$) | Elongation (%) | Transition Temp. in Charpy Impact Test (°C.) | Creep Rupture Strength (kgf/mm$^2$) | 600° C. 3000 hours Aging (weight %) | Hardenability |
| Example of the Present Invention | | | | | | | |
| 1 | 66.3 | 54.3 | 27.1 | −32 | 15.9 | — | ⊙ |
| 2 | 66.7 | 54.9 | 29.5 | −39 | 16.1 | 0.35 | ⊙ |
| 3 | 67.1 | 55.1 | 26.8 | −35 | 16.8 | 0.34 | ⊙ |
| 4 | 65.4 | 53.6 | 30.8 | −41 | 16.2 | — | ⊙ |
| 5 | 65.6 | 53.6 | 28.4 | −23 | 16.1 | 0.35 | ⊙ |
| 6 | 66.1 | 53.8 | 29.1 | −36 | 16.0 | — | ⊙ |
| 7 | 63.5 | 52.8 | 33.3 | −30 | 16.7 | 0.33 | ⊙ |
| 8 | 68.3 | 57.3 | 28.0 | −41 | 17.7 | 0.23 | ⊙ |

TABLE 5-continued

| Steel No. | Room Temperature Tensile Test: Tensile Strength (kgf/mm²) | 0.2% Proof Strength (kgf/mm²) | Elongation (%) | Ductile-Brittle Transition Temp. in Charpy Impact Test (°C.) | 600° C. $10^4$ hours Creep Rupture Strength (kgf/mm²) | Amounts of W + Mo Precipitates after 600° C. 3000 hours Aging (weight %) | Hardenability |
|---|---|---|---|---|---|---|---|
| 9 | 70.5 | 57.9 | 27.4 | −28 | 17.0 | 0.38 | ⊙ |
| 10 | 62.3 | 53.4 | 38.1 | −41 | 15.8 | 0.29 | ⊙ |
| 11 | 71.8 | 59.8 | 26.5 | −33 | 17.0 | — | ⊙ |
| 12 | 63.4 | 53.7 | 34.1 | −41 | 15.7 | — | ⊙ |
| 13 | 68.7 | 57.4 | 26.5 | −41 | 16.8 | — | ⊙ |
| 14 | 69.2 | 57.8 | 27.8 | −45 | 17.8 | — | ⊙ |
| 15 | 66.1 | 55.3 | 28.1 | −43 | 17.1 | — | ⊙ |
| 16 | 67.2 | 56.7 | 27.4 | −45 | 16.4 | — | ⊙ |
| 17 | 61.2 | 51.8 | 32.4 | −49 | 17.7 | — | ⊙ |
| 18 | 66.4 | 54.5 | 33.8 | −50 | 15.8 | — | ⊙ |
| 19 | 64.7 | 54.5 | 30.1 | −51 | 16.2 | — | ⊙ |
| 20 | 66.1 | 55.1 | 28.9 | −45 | 16.9 | — | ⊙ |

Note: In the column of Hardenability, ⊙: Bainite only (good hardenability)

TABLE 6

| Steel No. | Room Temperature Tensile Test: Tensile Strength (kgf/mm²) | 0.2% Proof Strength (kgf/mm²) | Elongation (%) | Ductile-Brittle Transition Temp. in Charpy Impact Test (°C.) | 600° C. $10^4$ hours Creep Rupture Strength (kgf/mm²) | Amounts of W + Mo Precipitates after 600° C. 3000 hours Aging (weight %) | Hardenability |
|---|---|---|---|---|---|---|---|
| Example of the Present Invention | | | | | | | |
| 21 | 68.3 | 56.6 | 29.9 | −49 | 16.4 | — | ⊙ |
| 22 | 64.7 | 53.1 | 33.1 | −35 | 16.8 | — | ⊙ |
| 23 | 70.4 | 59.1 | 24.9 | −47 | 17.5 | — | ⊙ |
| 24 | 65.5 | 55.9 | 26.1 | −33 | 16.9 | — | ⊙ |
| 25 | 64.3 | 53.4 | 28.9 | −41 | 17.5 | — | ⊙ |
| 26 | 63.5 | 52.4 | 30.1 | −25 | 16.3 | — | ⊙ |
| 27 | 63.5 | 53.1 | 30.1 | −26 | 17.1 | — | ⊙ |
| 28 | 62.5 | 51.4 | 28.7 | −23 | 16.1 | — | ⊙ |
| 29 | 71.7 | 60.1 | 26.8 | −31 | 16.8 | — | ⊙ |
| 30 | 68.6 | 67.5 | 27.1 | −28 | 16.6 | — | ⊙ |
| 31 | 66.7 | 55.2 | 29.5 | −33 | 17.0 | — | ⊙ |
| 32 | 62.1 | 51.3 | 33.4 | −50 | 16.4 | — | ⊙ |
| 33 | 71.2 | 60.0 | 25.1 | −48 | 17.5 | — | ⊙ |
| 34 | 68.7 | 56.7 | 30.1 | −47 | 17.8 | — | ⊙ |
| 35 | 66.5 | 55.8 | 30.1 | −28 | 17.3 | — | ⊙ |

Note: In the column of Hardenability, ⊙: Bainite only (good hardenability)

What is claimed is:

1. A low Mn-low Cr ferritic heat resistant steel excellent in high temperature strength consisting essentially of, in weight %:

| | | |
|---|---|---|
| 0.02–0.20% C, | up to 0.7% Si | less than 0.1% Mn, |
| up to 0.8% Ni, | 0.8–3.5% Cr, | 0.01–3.0% W, |
| 0.1–0.5% V, | 0.01–0.20% Nb, | 0.001–0.05% Al, |
| 0.0005–0.05% Mg, | 0.0005–0.01% B, | less than 0.05% N, |
| up to 0.03% P, | up to 0.015% S, | 0.001–0.05% Ti, |

and the balance Fe and incidental impurities, wherein the B content is defined so as to satisfy the following formula:

$$(14/11)B > N - N(V/51)/\{(C/12) + (N/14)\} - N(Nb/93)/\{(C/12) + (N/14)\} - N(Ti/48)/\{(C/12) + (N/14)\}.$$

2. A low Mn-low Cr ferritic heat resistant steel according to claim 1, further comprising 0.01–1.5% Mo.

3. A low Mn-low Cr ferritic heat resistant steel according to claim 1, further comprising one or more elements selected from the group consisting of:

| | | |
|---|---|---|
| 0.01–0.02% La, | 0.01–0.02% Ce, | 0.01–0.02% Y, |
| 0.01–0.02% Ca, | 0.01–0.02% Ta and | 0.01–0.02% Zr. |

4. A low Mn-low Cr ferritic heat resistant steel according to claim 1, further comprising 0.01–1.5% Mo, and one or more elements selected from the group consisting of:

| | | |
|---|---|---|
| 0.01–0.02% La, | 0.01–0.02% Ce, | 0.01–0.02% Y, |
| 0.01–0.02% Ca, | 0.01–0.02% Ta and | 0.01–0.02% Zr. |

5. A low Mn-low Cr ferritic heat resistant steel according to claim 1, having a bainitic microstructure.

6. A low Mn-low Cr ferritic heat resistant steel according to claim 1, having a mixed structure of predominantly bainite and minor amounts of ferrite, martensite and/or pearlite.

7. A low Mn-low Cr ferritic heat resistant steel according to claim 1, wherein N is in the form of TiN and Ti(C,N) precipitates.

8. A low Mn-low Cr ferritic heat resistant steel according to claim 1, wherein Mn is present in an amount which minimizes coarsening of $M_6C$ carbides at temperatures above 550° C.

9. A low Mn-low Cr ferritic heat resistant steel according to claim 1, wherein the steel is substantially free of δ-ferrite.

10. A low Mn-low Cr ferritic heat resistant steel according to claim 1, wherein V and Nb are present in the form of precipitates and W is present in the form of tungsten carbides.

11. A low Mn-low Cr ferritic heat resistant steel according to claim 1, wherein the steel has been subjected to normalizing and tempering heat treatments.

12. A low Mn-low Cr ferritic heat resistant steel according to claim 1, wherein the W is present in an amount of <0.5% tungsten carbide precipitates after heating at 600° C. for $10^4$ hours.

13. A low Mn-low Cr ferritic heat resistant steel according to claim 1, wherein V is in the form of V(C,N) precipitates.

14. A low Mn-low Cr ferritic heat resistant steel according to claim 1, wherein Nb is in the form of Nb(C,N) precipitates.

15. A low Mn-low Cr ferritic heat resistant steel according to claim 1, wherein Ti is in the form of Ti(C,N) precipitates.

16. A low Mn-low Cr ferritic heat resistant steel according to claim 1, wherein N≦0.02%.

17. A low Mn-low Cr ferritic heat resistant steel according to claim 1, wherein the steel has a creep rupture strength of over 15 kgf/mm$^2$ at 600° C. for $10^4$ hours.

18. A low Mn-low Cr ferritic heat resistant steel according to claim 1, wherein the steel has a room temperature elongation of over 25%.

19. A low Mn-low Cr ferritic heat resistant steel according to claim 1, wherein the steel has a ductile-to-brittle transition temperature below −25° C.

* * * * *